US009249960B2

(12) United States Patent
Wang

(10) Patent No.: US 9,249,960 B2
(45) Date of Patent: Feb. 2, 2016

(54) SPOTLIGHT HAVING 360-DEGREE HORIZONTAL LIGHTING

(71) Applicant: Mao-Shen Wang, New Taipei (TW)

(72) Inventor: Mao-Shen Wang, New Taipei (TW)

( * ) Notice: Subject to any disclaimer, the term of this patent is extended or adjusted under 35 U.S.C. 154(b) by 0 days.

(21) Appl. No.: 14/450,841

(22) Filed: Aug. 4, 2014

(65) Prior Publication Data

US 2015/0109800 A1 Apr. 23, 2015

(30) Foreign Application Priority Data

Oct. 23, 2013 (TW) ..... 102219769 U

(51) Int. Cl.

| | |
|---|---|
| ***F21V 21/30*** | (2006.01) |
| ***F21V 14/02*** | (2006.01) |
| ***F21V 21/15*** | (2006.01) |
| ***F21S 8/00*** | (2006.01) |

(52) U.S. Cl.

CPC ..... *F21V 21/30* (2013.01); *F21S 8/003* (2013.01); *F21V 14/02* (2013.01); *F21V 21/15* (2013.01)

(58) Field of Classification Search

CPC ..... F21V 21/30; F21V 21/15; F21V 21/14; F21V 21/145; F21V 15/01; F21V 31/00; F21V 21/28; F21V 21/29; F21V 14/02; F21V 21/16; F21V 21/18; F21V 21/20; F21V 14/00; F21V 14/025; F21V 17/02; F21V 19/02; F21S 8/003; F21W 2131/10

See application file for complete search history.

(56) References Cited

U.S. PATENT DOCUMENTS

| | | | | | |
|---|---|---|---|---|---|
| 5,057,985 | A * | 10/1991 | Kreutzer, Jr. | F21V 21/30 | 340/471 |
| 5,584,560 | A * | 12/1996 | Gosswiller | B60Q 1/245 | 362/233 |
| 5,842,768 | A * | 12/1998 | Menke | B60Q 1/2611 | 362/286 |
| 6,955,447 | B2 * | 10/2005 | Lui | B60Q 1/245 | 362/228 |
| 2008/0218328 | A1 * | 9/2008 | Chiu | B60Q 1/2611 | 340/468 |

* cited by examiner

*Primary Examiner* — Bao Q Truong
(74) *Attorney, Agent, or Firm* — Bacon & Thomas, PLLC

(57) ABSTRACT

A spotlight includes a lamp housing, a support pivotally supporting the lamp housing from below and a lamp assembly pivotally installed inside the lamp housing, wherein an electrically-conductive slip ring is provided at where the lamp housing is pivotally connected to the support to allow the spotlight capably providing 360-degree horizontal lighting.

4 Claims, 4 Drawing Sheets

SPOTLIGHT HAVING 360-DEGREE HORIZONTAL LIGHTING

BACKGROUND OF THE INVENTION

1. Field of the Present Invention

The present invention relates to spotlights, and more particularly to a spotlight using an electrically-conductive slip ring and having 360-degree horizontal lighting.

2. Description of Related Art

Referring to FIG. 1, a conventional spotlight 90 is a lamp capable of changing its lighting direction vertically and horizontally. The spotlight 90 comprises a lamp housing 91 and a support 92 pivotally supporting the lamp housing 91 from below.

In the lamp housing 91, a partition 94 divides the interior of the lamp housing 91 into a lamp compartment 91*a* and a driving-device compartment 91*b*.

A lamp assembly 95 is pivotally installed in the lamp compartment 91*a*. A vertical driving device 96 is installed in the driving-device compartment 91*b* and affixed to the middle partition 94. A horizontal driving device 97 is fixedly installed inside the support 92.

A curved rack 95*a* is provided behind the lamp assembly 95, for the vertical driving device 96 to engage and move the lamp assembly 95. In response to the driving force from the vertical driving device 96, the lamp assembly 95 tilts up and down in the lamp compartment 91*a* of the lamp housing 91, so as to provide a vertically changeable lighting angle.

A ring gear 91*c* is provided below the lamp housing 91, for the horizontal driving device 97 to engage and move the lamp assembly 95. In response to the driving force from the horizontal driving device 97, the lamp housing 91, together with the lamp assembly 95 installed in its lamp compartment 91*a*, swivels right and left against the support 92, so as to provide a horizontally changeable lighting angle.

The conventional spotlight 90 is powered through a cable 98. The cable 98 includes three sets of power cords. The first power cord set 98*a* is electrically connected to the lamp assembly 95 of the conventional spotlight 90, for powering the illumination of the lamp assembly 95. The second power cord set 98*b* is electrically connected to the motor of the vertical driving device 96 of the conventional spotlight 90, for powering the motor to rotate forward or reversely. The third power cord set 98*c* is electrically connected to the motor of the horizontal driving device 97 of the conventional spotlight 90, for powering the motor to rotate forward or reversely.

However, in use, when the conventional spotlight 90 tries to make a horizontal 360-degree rotation, the three power cord sets 98*a*, 98*b* and 98*c* of the cable 98 tend to twist and get pulled apart. For this reason, the conventional spotlight 90 is limited by the three power cord sets 98*a*, 98*b* and 98*c* and fails to provide 360-degree horizontal illumination.

SUMMARY OF THE INVENTION

In view of this, the primary objective of the present invention is to provide a spotlight having 360-degree horizontal lighting, which implements an electrically-conductive slip ring to eliminate the problems about twist and pulling-apart of the power cords.

The spotlight of the present invention comprises a lamp housing, a support pivotally supporting the lamp housing from below, a lamp assembly pivotally installed inside the lamp housing, and an electrically-conductive slip ring provided at where the lamp housing is pivotally connected to the support. The lamp housing contains therein a vertical partition, a horizontal partition, a vertical driving device and a horizontal driving device. The support is atop provided with a stationary gear. The vertical partition divides the interior of the lamp housing into a lamp compartment and a driving-device compartment, for the lamp assembly to be pivotally installed in the lamp compartment of the lamp housing. The horizontal partition forms a floor of the lamp housing. The vertical driving device is installed in the driving-device compartment of the lamp housing and is fixed to the vertical partition, for driving the lamp assembly to tilt up and down within the lamp compartment of the lamp housing. The horizontal driving device is also installed in the driving-device compartment, fixed to the horizontal partition, and engaged with the stationary gear of the support, for driving the lamp housing and the lamp assembly to synchronously swivel right and left against the support.

The electrically-conductive slip ring comprises a stator component and a rotator component. The stator component is fixed to the support and the rotator component is combined with the horizontal partition of the lamp housing as an integrated structure. The rotator component can make 360-degree rotation against the stator component, and is ensured with the power from the stator component during the 360-degree rotation, so as to make the spotlight capable of providing 360-degree horizontal lighting.

The lamp housing is preferably constructed from an upper half and a lower half, and the support has a bottom thereof preferably equipped with an anti-slip board.

With the electrically-conductive slip ring, the disclosed spotlight of the present invention has the lamp housing making 360-degree rotation with respect to the support without the problem about twisted cords, while the rotator component is ensured with the power from the stator component during the 360-degree rotation, so that the desired 360-degree horizontal lighting can be provided.

DETAILED DESCRIPTION OF THE PREFERRED EMBODIMENT

Figure 1:
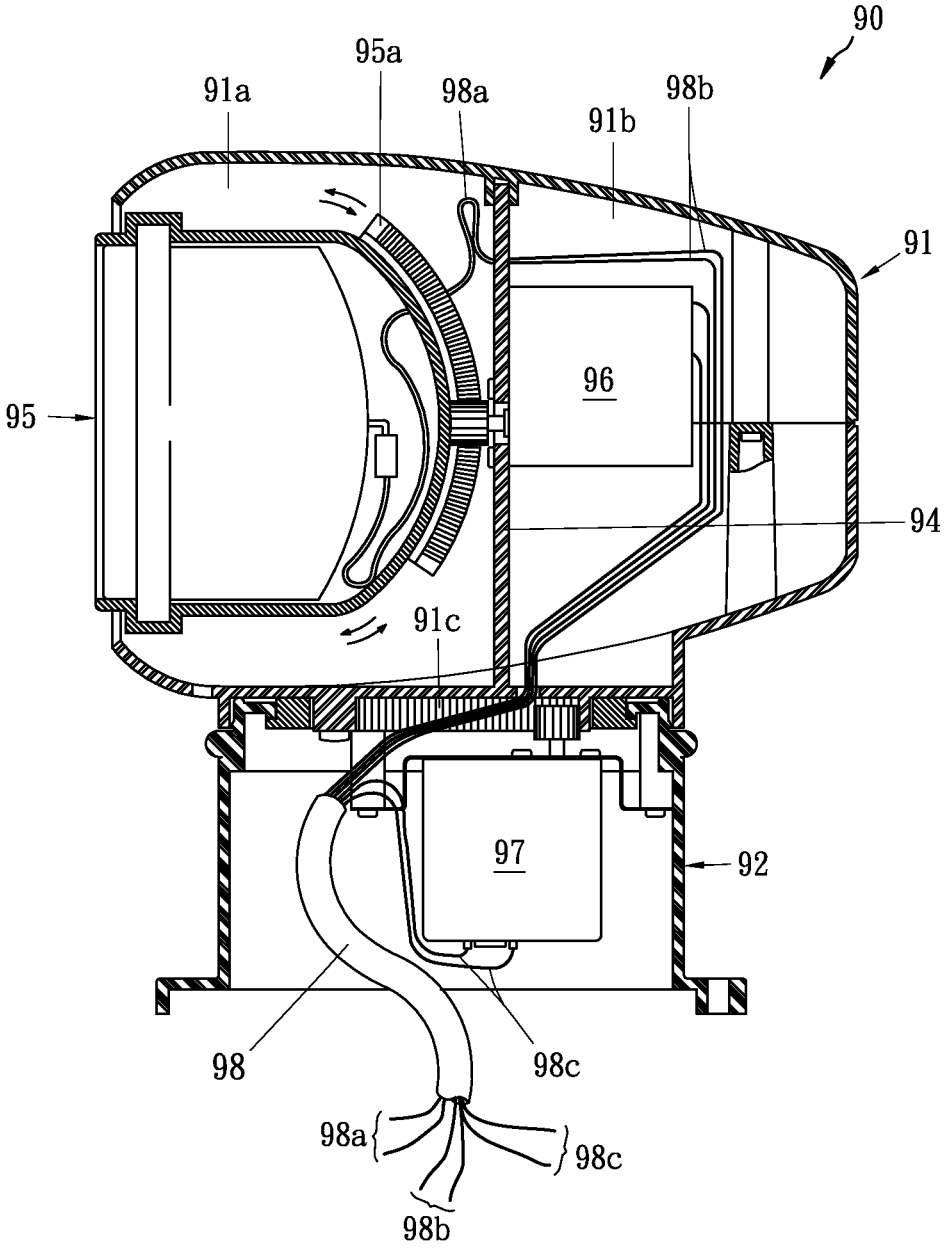
FIG. 1 prior art
FIG. 1 is a cross-sectional view of a conventional spotlight.
Figure 2:
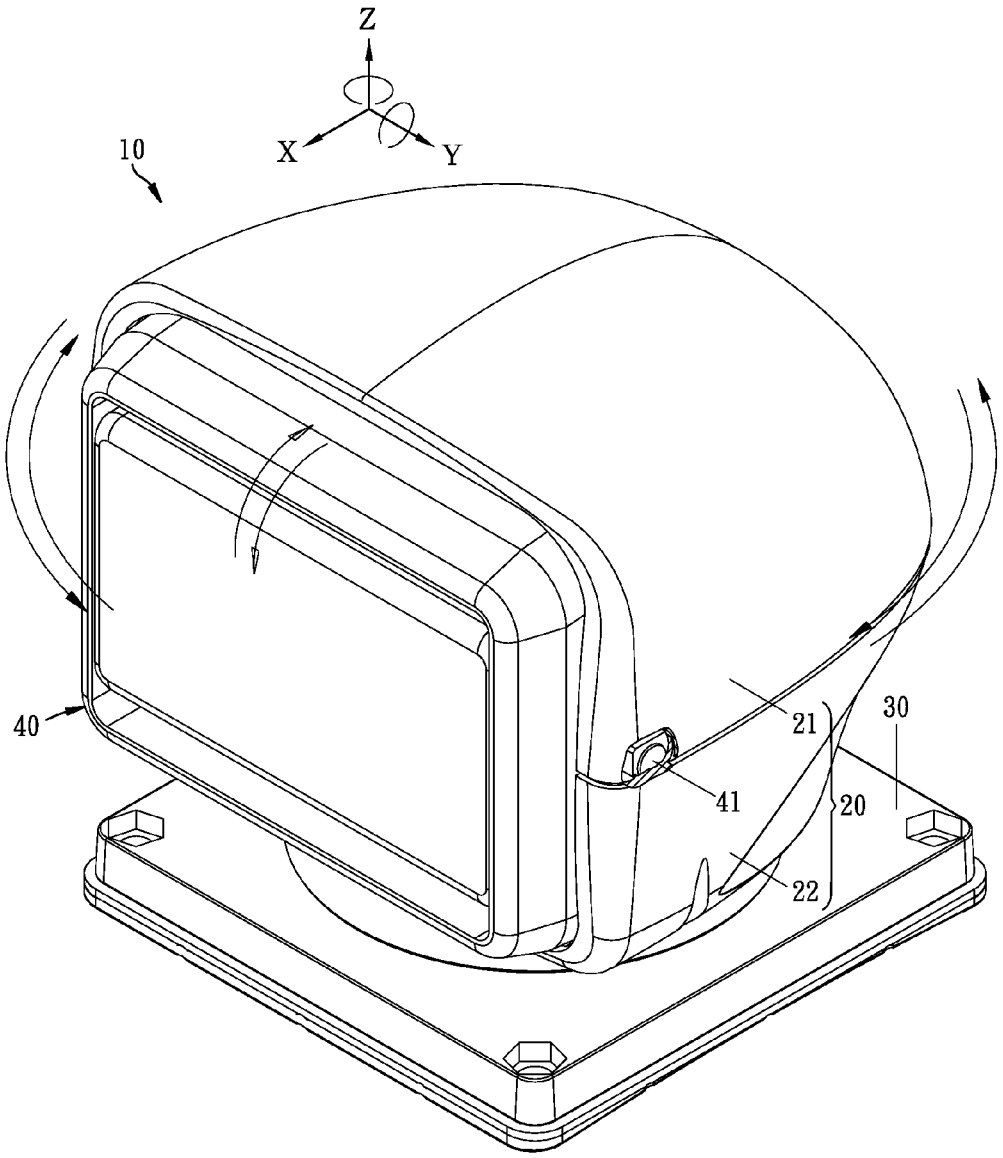
FIG. 2 is a schematic drawing of a spotlight according to the present invention.
Figure 3:
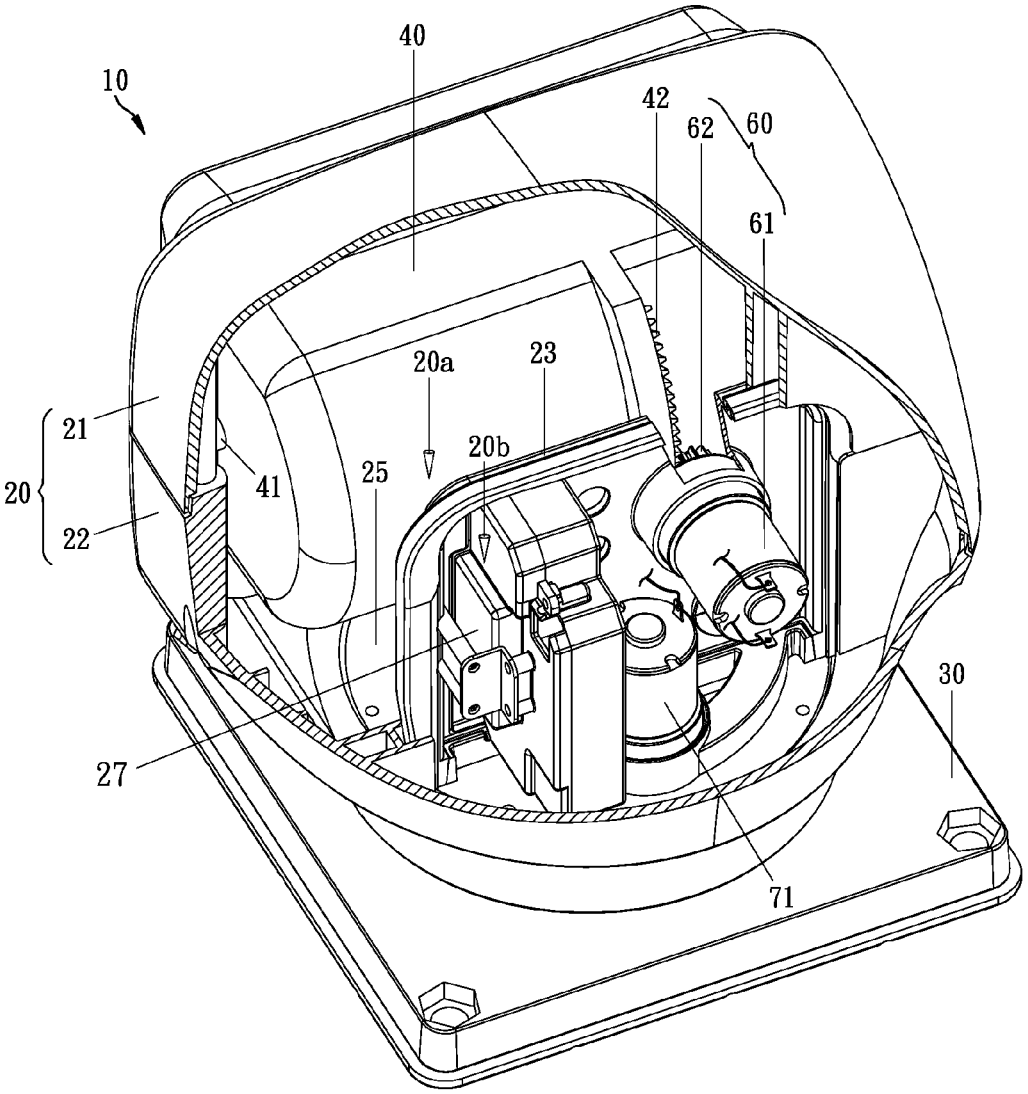
FIG. 3 is a cutaway view of the spotlight of FIG. 2 showing the interior of its lamp housing.
Figure 4:
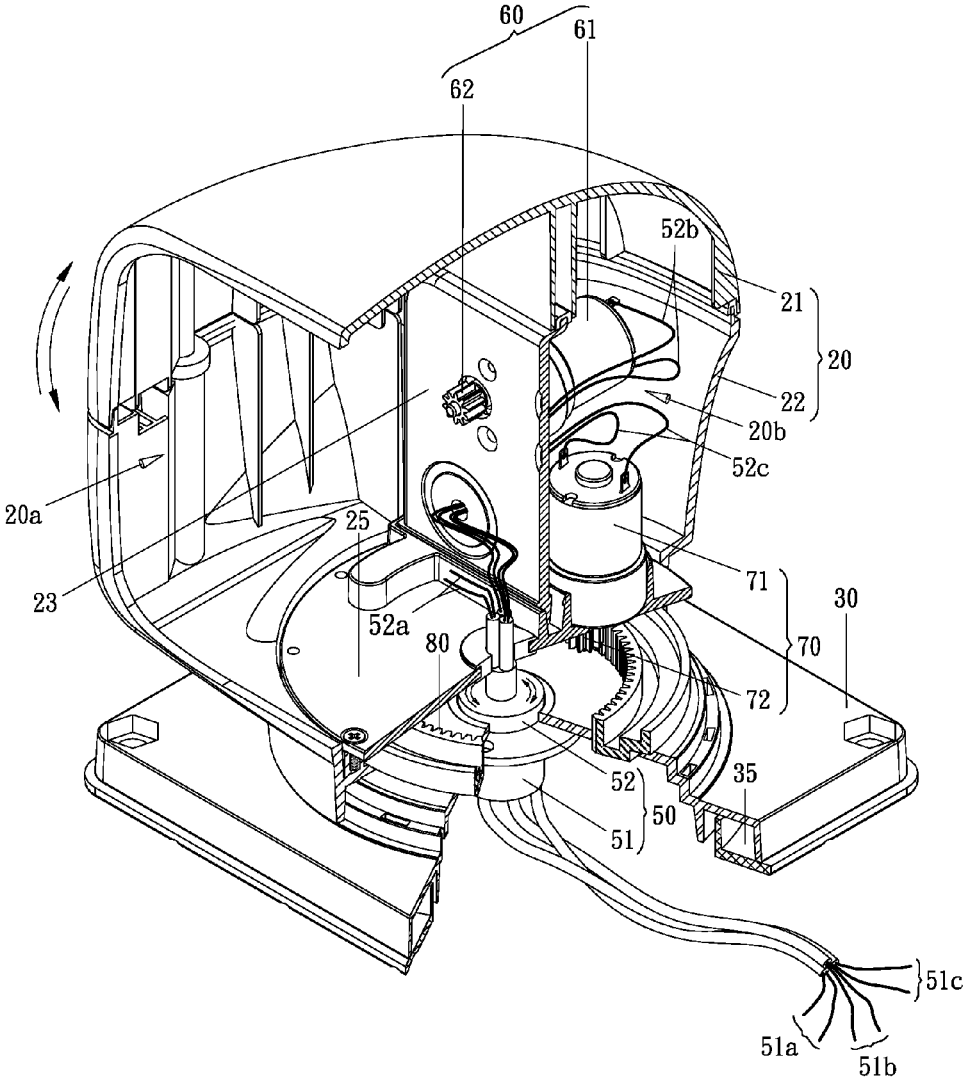
FIG. 4 is another cutaway view of the spotlight of FIG. 2 showing an electrically-conductive slip ring between its lamp housing and support.

Referring to FIG. 2 through FIG. 4, a spotlight 10 of the present invention is a versatile spotlight having its illuminating angle vertically and horizontally changeable, and particularly capable of providing 360-degree horizontal lighting.

The disclosed spotlight 10 comprises a lamp housing 20, a support 30 pivotally supporting the lamp housing 20 from below, a lamp assembly 40 pivotally installed inside the lamp housing 20 and an electrically-conductive slip ring 50. The lamp housing 20 contains therein a vertical driving device 60 and a horizontal driving device 70. The support 30 is atop equipped with a stationary gear 80 and at bottom equipped with an anti-slip board 35 for preventing the support 30 from slip.

The lamp housing 20 is composed of an upper half 21 and a lower half 22, and further contains therein a vertical partition 23 and a horizontal partition 25. When assembled, the vertical partition 23 divides the interior of the lamp housing 20 into a lamp compartment 20*a* and a driving-device compartment 20*b*. The horizontal partition 25 is fixed to the lower half 22 of the lamp housing 20 through fixing members and forms a floor of the lamp housing 20.

The vertical driving device 60 comprises a reversible motor 61 and a pinion 62. The vertical driving device 60 is installed inside the driving-device compartment 20*b* of the lamp housing 20 and is fixed to the vertical partition 23 of the lamp housing 20.

The lamp assembly 40 has two laterals, and each lateral is provided with a pivot 41 for the lamp assembly 40 to be pivotally installed in the lamp compartment 20*a* of the lamp housing 20.

A recessed rack 42 extends along a back of the lamp assembly 40 configured to be engaged with the pinion 62 of the vertical driving device 60. In response to the driving force coming from the reversible motor 61 of the vertical driving device 60 through the pinion 62, the lamp assembly 40 tilts up and down in the lamp compartment 20*a* of the lamp housing 20, so as to change its illuminating angle vertically.

The horizontal driving device 70 comprises a reversible motor 71 and a pinion 72. The horizontal driving device 70 is installed inside the driving-device compartment 20*b* of the lamp housing 20. The reversible motor 71 is fixed to the horizontal partition 25 of the lamp housing 20 and has a pinion 72 engaged with the stationary gear 80 of the support 30. In response to the driving force coming from the reversible motor 71 of the horizontal driving device 70 through the pinion 72, the lamp housing 20 and the lamp assembly 40 installed in its lamp compartment 20*a* swivel right and left against the support 30, so as to change its illuminating angle horizontally.

As shown in FIG. 3 and FIG. 4, the electrically-conductive slip ring 50 is a known electrical device, also referred to as a rotary electrical joint. It comprises a stator component 51 and a rotator component 52. The rotator component 52 is rotatable against the stator component 51, and allows power transmission from the stationary stator component 51 to the rotatable rotator component 52.

The electrically-conductive slip ring 50 is located at where the lamp housing 20 is pivotally connected to the support 30, and on the rotational axis of the lamp housing 20 rotating against the support 30. The stator component 51 of the electrically-conductive slip ring 50 is fixed to the support 30. The rotator component 52 of the electrically-conductive slip ring 80 is combined with the horizontal partition 25 of the lamp housing 20 as an integrated structure.

When the lamp housing 20 rotates against the support 30, the rotator component 52 of the electrically-conductive slip ring 50 rotates against the stator component 51 synchronously. With the electrically-conductive slip ring 50, the disclosed spotlight 10 of the present invention has the lamp housing 20 making 360-degree rotation with respect to the support 30 without the problem about twisted cords, while the rotator component 52 is ensured with the power from the stator component 51 during the 360-degree rotation.

The stator component 51 of the electrically-conductive slip ring 50 has three sets of power cords 51*a*, 51*b* and 51*c*. The rotator component 52 of the electrically-conductive slip ring 50 also has three sets of power cords 52*a*, 52*b* and 52*c* that correspond to the three sets of power cords 51*a*, 51*b* and 51*c* of the stator component 51, respectively.

The power cord 51*a* of the stator component 51 serves to supply power to the power cord 52*a* of the rotator component 52. The power cord 52*a* of the rotator component 52 is electrically connected to the lamp assembly 40 through a controlling box 27. By controlling the controlling box 27 to supply power to the lamp assembly 40 or not, a user can control the lamp assembly 40 to illuminate or go out.

The power cord 51*b* of the stator component 51 serves to supply power to the power cord 52*b* of the rotator component 52. The power cord 52*b* of the rotator component 52 is electrically connected to the reversible motor 61 of the vertical driving device 60 through the controlling box 27. By controlling the controlling box 27 to supply power to the reversible motor 61 or not, a user can control the lamp assembly 40 to change its illuminating angle vertically.

The power cord 51*c* of the stator component 51 serves to supply power to the power cord 52*c* of the rotator component 52. The power cord 52*c* of the rotator component 52 is electrically connected to the reversible motor 71 of the horizontal driving device 70 through the controlling box 27. By controlling the controlling box 27 to supply power to the reversible motor 71 or not, a user can control the lamp assembly 40 to change its illuminating angle horizontally, including providing 360-degree horizontal rotation and lighting.

What is claimed is:

1. A spotlight having 360-degree horizontal lighting, comprising:

a lamp housing, containing therein a vertical partition to divide an interior of the lamp housing into a lamp compartment and a driving-device compartment, a horizontal partition to form a floor of the lamp housing, a vertical driving device installed in the driving-device compartment and fixed to the vertical partition, and a horizontal driving device installed in the driving-device compartment and fixed to the horizontal partition;

a lamp assembly, pivotally installed in the lamp compartment of the lamp housing and driven by the vertical driving device to tilt up and down; and a support, pivotally supporting the lamp housing from below and having a top provided with a stationary gear configured to be engaged with the horizontal driving device to allow both the lamp housing and the lamp assembly driven by the horizontal driving device to synchronously swivel right and left against the support;

wherein the improvement comprises:

an electrically-conductive slip ring located at where the lamp housing is pivotally connected to the support, comprising a stator component fixed to the support and a rotator component combined with the horizontal partition of the lamp housing as an integrated structure, wherein the rotator component is allowed to make 360-degree rotation against the stator component and ensured with power supplied by the stator component during the 360-degree rotation.

2. The spotlight of claim 1, wherein the lamp housing is constructed from an upper half and a lower half.

3. The spotlight of claim 1, wherein the support has a bottom thereof equipped with an anti-slip board.

4. The spotlight of claim 2, wherein the support has a bottom thereof equipped with an anti-slip board.

* * * * *